US007817927B2

(12) United States Patent
Kawahara

(10) Patent No.: US 7,817,927 B2
(45) Date of Patent: Oct. 19, 2010

(54) IMAGE FORMING APPARATUS WITH DEVELOPER COLLECTION

(75) Inventor: Eiji Kawahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 478 days.

(21) Appl. No.: 11/845,910

(22) Filed: Aug. 28, 2007

(65) Prior Publication Data

US 2008/0056739 A1 Mar. 6, 2008

(30) Foreign Application Priority Data

Aug. 29, 2006 (JP) ..... 2006-232585

(51) Int. Cl.
*G03G 21/12* (2006.01)

(52) U.S. Cl. ..... 399/35

(58) Field of Classification Search ..... 399/35, 399/360, 359, 257, 98, 99
See application file for complete search history.

(56) References Cited

U.S. PATENT DOCUMENTS

| | | | | |
|---|---|---|---|---|
| 4,730,205 | A * | 3/1988 | Ogiri et al. | 399/35 |
| 5,655,178 | A * | 8/1997 | Ishikawa et al. | 399/102 |
| 6,081,676 | A * | 6/2000 | Inomata | 399/25 |
| 6,819,885 | B2 | 11/2004 | Serizawa | |
| 7,212,750 | B2 * | 5/2007 | Kawai | 399/12 |
| 2003/0219264 | A1 * | 11/2003 | Serizawa | 399/35 |

FOREIGN PATENT DOCUMENTS

| | | |
|---|---|---|
| JP | 60-056069 | 4/1985 |
| JP | 60-133474 | 9/1985 |
| JP | 62-127784 | 6/1987 |
| JP | 63-095486 | 4/1988 |
| JP | 63-135372 | 9/1988 |
| JP | 1-105955 | 7/1989 |
| JP | 02-047671 | 3/1990 |
| JP | 07-084480 | 3/1995 |
| JP | 11-305623 | 11/1999 |
| JP | 2002-148884 | 5/2002 |
| JP | 2002-341710 | 11/2002 |
| JP | 2003-345202 | 12/2003 |
| JP | 2004-252491 | 9/2004 |
| JP | 2004-286790 | 10/2004 |
| JP | 2005-024949 | 1/2005 |
| JP | 2005-345941 | 12/2005 |
| JP | 2006-018329 | 1/2006 |

* cited by examiner

*Primary Examiner*—David M. Gray
*Assistant Examiner*—Billy J Lactaoen
(74) *Attorney, Agent, or Firm*—Banner & Witcoff, LTD

(57) ABSTRACT

One aspect of the present invention can include an image forming apparatus having an image forming portion configured to form an image using developer, a recovery portion configured to recover the developer, a accommodating portion having a first chamber for accommodating developer recovered by the recovery portion, a second chamber which is connected to the first chamber and has a groove, a partition member positioned between the first chamber and the second chamber and which is movable by a pressure of the developer deposited in the first chamber, and a sensing portion having two positions for sensing developer deposited in the groove.

20 Claims, 7 Drawing Sheets

IMAGE FORMING APPARATUS WITH DEVELOPER COLLECTION

CROSS REFERENCE TO RELATED APPLICATION

This application claims priority from Japanese Patent Application No. 2006-232585 filed Aug. 25, 2006. The entire content of this priority application is incorporated herein by reference.

TECHNICAL FIELD

This disclosure relates to an image forming apparatus, and more particularly, to an image forming apparatus including a cleaning apparatus for recovering developer.

BACKGROUND

An image forming apparatus (such as a laser printer) conventionally includes a cleaning apparatus for recovering toner (developer) remaining on the surface of a belt or an image bearing member and the like. Such a cleaning apparatus is limited in capacity of a accommodating chamber for storing toner to be recovered. Accordingly, a toner detection sensor is needed in order to detect whether the accommodating chamber is filled with toner. If a full condition is detected, printing operation is inhibited or the full condition is indicated to prompt the user to replace the cleaning apparatus.

The aforementioned toner detection sensor is arranged in a center of a rear wall of the accommodating chamber to detect whether toner reaches the position. However, because toner is deposited differently depending on the content of an image to be printed and the like, the toner detection sensor may detect a toner-full condition before the toner in the accommodating chamber reaches a predetermined amount, if the toner is unevenly deposited near the center in such a configuration.

With this in mind, conventionally, there has been a configuration in which a small sensing chamber is located at a rear side of the accommodating chamber, a partition member which is opened by a toner pressure is located at an opening of the sensing chamber, and a toner detection sensor is arranged in the rear wall of the sensing chamber. According to this configuration, toner enters the sensing chamber for detection after the accommodating chamber is filled with toner, thereby improving the sensing accuracy.

However, the above configuration is inconvenient for the user since printing operation terminates without notice when the accommodating chamber is filled with toner (full condition). It is preferable to detect a near-full condition in which toner is approaching the full condition and inform the user of the near-full condition before toner reaches the full condition.

Thus, there is an need in the art for an image forming apparatus capable of sensing the full condition and the near-full condition of the cleaning apparatus with a high accuracy.

SUMMARY

One aspect of the present invention can include an image forming apparatus having an image forming portion configured to form an image using developer, a recovery portion configured to recover the developer, a accommodating portion having a first chamber for accommodating developer recovered by the recovery portion, a second chamber which is connected to the first chamber and has a groove, a partition member positioned between the first chamber and the second chamber and which is movable by a pressure of the developer deposited in the first chamber, and a sensing portion having two positions for sensing developer deposited in the groove.

BRIEF DESCRIPTION OF THE DRAWINGS

Illustrative aspects in accordance with the invention will be described in detail with reference to the following figures wherein.

DETAILED DESCRIPTION

An illustrative aspect of the present invention will now be described with reference to FIGS. 1 to 6.

(Entire Configuration of Laser Printer)

Figure 1:
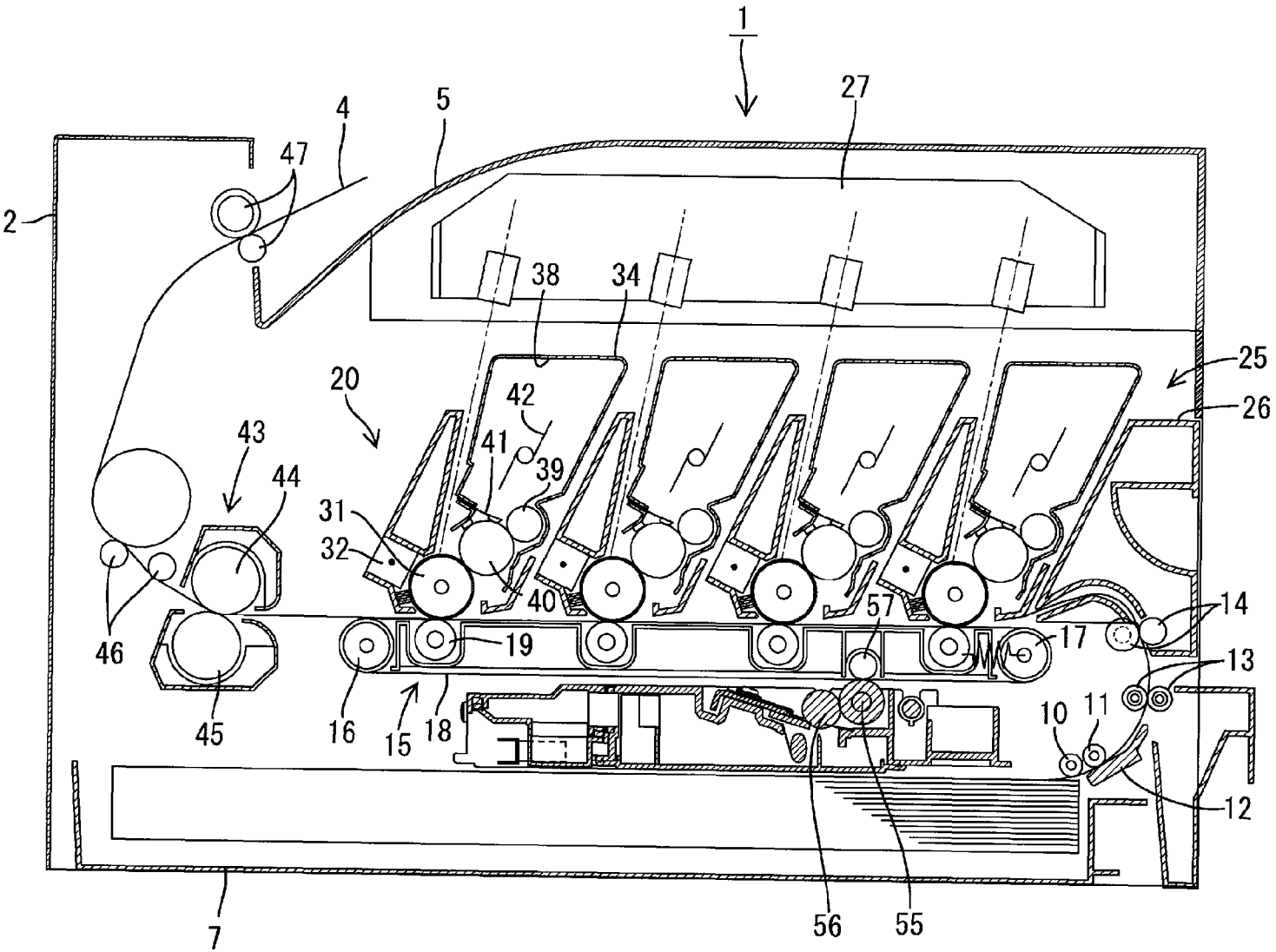
FIG. 1 is a side sectional view showing a schematic configuration of a laser printer in accordance with an illustrative aspect of the present invention.

FIG. 1 is a side sectional view showing a schematic configuration of a image forming apparatus 1 according to one aspect of the present invention. In the description below, the right side in FIG. 1 shows the front.

The image forming apparatus 1 can be a laser printer, or more specifically can be a direct transfer tandem type color laser printer. Image forming apparatus 1 is provided with a generally box-like main body casing 2 (example of main unit) as shown in FIG. 1. This main body casing 2 includes an image forming portion 20 and the like for printing an image on recording medium 4 (such as a paper sheet, plastic sheet, or the like), which will be more fully described later. A sheet discharge tray 5, on which recording mediums 4 are stacked after image formation, is formed on the upper surface of the main body casing 2.

A feed tray 7, on which recording mediums 4 are stacked for image formation, is forward-withdrawably inserted into a lower part of the main body casing 2. A pressing plate (not shown) which is inclinable so as to lift the front end side of a recording medium 4 is located on a bottom of the feed tray 7. A pickup roller 10, a separation roller 11 and a separation pad 12 press-contacted to the separation roller 11 by a urging force of a spring (not shown) are located in an upper front end position of the feed tray 7. A pair of powder removal rollers 13 are located obliquely upward over the pickup roller 10, over which a pair of registration rollers 14 is located.

The pressing plate presses a top-most recording medium 4 stacked on the feed tray 7 toward the pickup roller 10. Rotation of the pickup roller 10 introduces a recording medium in between the separation roller 11 and the separation pad 12 so that when there is a plurality of recording mediums, they are separated from each other. A recording medium 4 emerging from between the separation roller 11 and the separation pad 12 is conveyed through the powder removal roller 13 to a registration roller 14. The registration roller 14 transports the recording medium 4 onto a belt unit 15 at a predetermined time.

The belt unit 15 is detachably mounted on the main body casing 2 and is provided with a conveying belt 18 which is horizontally installed between a pair of belt supporting rollers 16 and 17, each roller arranged in distance at front and rear ends. The conveying belt 18, which can be a belt made from resin such as polycarbonate, cyclically moves counterclockwise (in FIG. 1) by the rotation of the belt supporting roller 17 at the rear end to convey the recording medium 4 backward. Inside the conveying belt 18, transfer rollers 19 are positioned to face photosensitive drums 31 of a process portion 25 (which will be described later). The transfer rollers 19 are provided in line at regular intervals in a direction from the front to the back, and the conveying belt 18 is held between the photosensitive drums 31 and the corresponding transfer rollers 19.

A transfer bias is applied in between the transfer roller 19 and the photosensitive drum 31 at the time of transfer.

A cleaning apparatus 50 (which will be more fully described later) for removing toner, paper powder and the like remaining on the conveying belt 18 is located under the belt unit 15.

An image forming portion 20 is configured with a scanner portion 27, a process portion 25, the aforementioned transfer rollers 19, a fixing device 43 and the like.

The scanner portion 27, which is located in an upper position in the main body casing 2, radiates a laser beam L by high-speed scanning for each color depending on specified image data onto the surface of the corresponding photosensitive drum 31.

The process portion 25 is forward-withdrawably inserted under the scanner portion 27 in the main body casing 2. The process portion 25 is provided with a frame 26 which is configured with a photosensitive drum 31 serving as an image bearing member, a charger 32 (i.e. a scorotron type), a developing cartridge 34 serving as a developing unit and the like, each of the pairs being located side by side in order from front to rear.

The photosensitive drum 31, which is provided with a grounded metal drum unit, can be formed by coating the surface with a positively charged photosensitive layer made of polycarbonate and the like. The charger 32 can use a charging wire (not shown) made of tungsten and the like to generate a corona discharge at the photosensitive drum 31 so that the surface is uniformly charged to positive polarity.

The developing cartridges 34 are detachably inserted into the frame 26, each cartridge corresponding to multiple colors (of, for example, black, cyan, magenta, and yellow). Each developing cartridge 34 includes a toner accommodating chamber 38 (one example of first chamber) in an upper position of the cartridge, under which is located a supply roller 39, a developing roller 40 and a thickness restricting blade 41. Each toner accommodating chamber 38 accommodates positively charged non-magnetic single-component toner as developer. In addition, each toner accommodating chamber 38 includes an agitator 42 for agitating toner.

The supply roller 39 can be formed by coating a metal roller shaft with a conductive foam material. The developing roller 40 can be formed by coating a metal roller shaft with a conductive rubber material. Toner is moved from within the toner accommodating chamber 38 to the developing roller 40 by the rotation of the supply roller 39, and then the toner is positively tribocharged between the supply roller 39 and the developing roller 40. In addition, with the rotation of the developing roller 40, the toner deposited on the developing roller 40 advances in between the thickness restricting blade 41 and the developing roller 40 so as to be tribocharged enough to form a layer with a predetermined thickness which is born on the developing roller 40.

The surface of the photosensitive drum 31 is uniformly positively charged during rotation by the charger 32. Then, the surface is exposed to a laser beam from the scanner portion 27 by high-speed scanning, thereby forming an electrostatic latent image corresponding to an image to be formed on a recording medium 4.

Next, when the developing roller 40 is rotated, the positively charged toner born on the developing roller 40 is contacted to the facing photosensitive drum 31, and the toner is supplied to an electrostatic latent image formed on the surface of the photosensitive drum 31. As a result, the electrostatic latent image of the photosensitive drum 31 is visualized, and the surface of the photosensitive drum 31 bears a toner image having toner deposited only on the exposed portions.

Then, while a recording medium 4 (conveyed by the conveying belt 18) passes through each transfer position between the photosensitive drum 31 and the transfer roller 19, a toner image on the surface of each photosensitive drum 31 is sequentially transferred to the recording medium 4 by a negative transfer bias applied to the transfer roller 19. Then, the recording medium 4 (having a transferred toner image) can be conveyed to a fixing device 43.

The fixing device 43 is arranged rearward of the conveying belt 18 in the main body casing 2. The fixing device 43 includes a rotatably driven heat roller 44 having a heat source, such as a halogen lamp, and a dependently rotated pressure roller 45 which is arranged under the heat roller 44 and is facing and pressing against the heat roller 44. In the fixing device 43, a recording medium 4 (bearing a toner image) is interposed between the heat roller 44 and the pressure roller 45 to heat-fix the toner image on the recording medium 4. The heat-fixed recording medium 4 is conveyed to the discharge roller 47 arranged upward of the main body casing 2 through the conveying roller 46 located obliquely upward and rearward of the fixing device 43 which then discharges the recording medium 4 onto the discharge tray 5.

(Basic Structure of Cleaning Apparatus)

Figure 2:
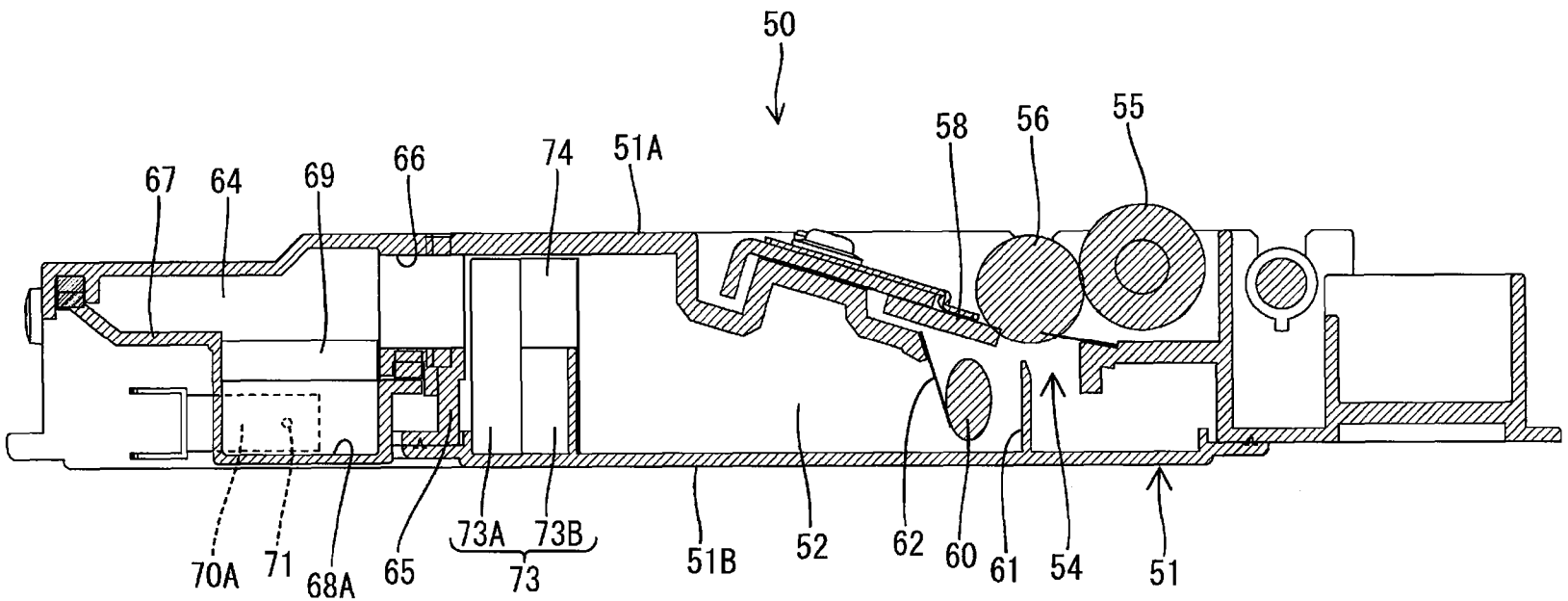
FIG. 2 is a side sectional view of a cleaning apparatus.
Figure 3:
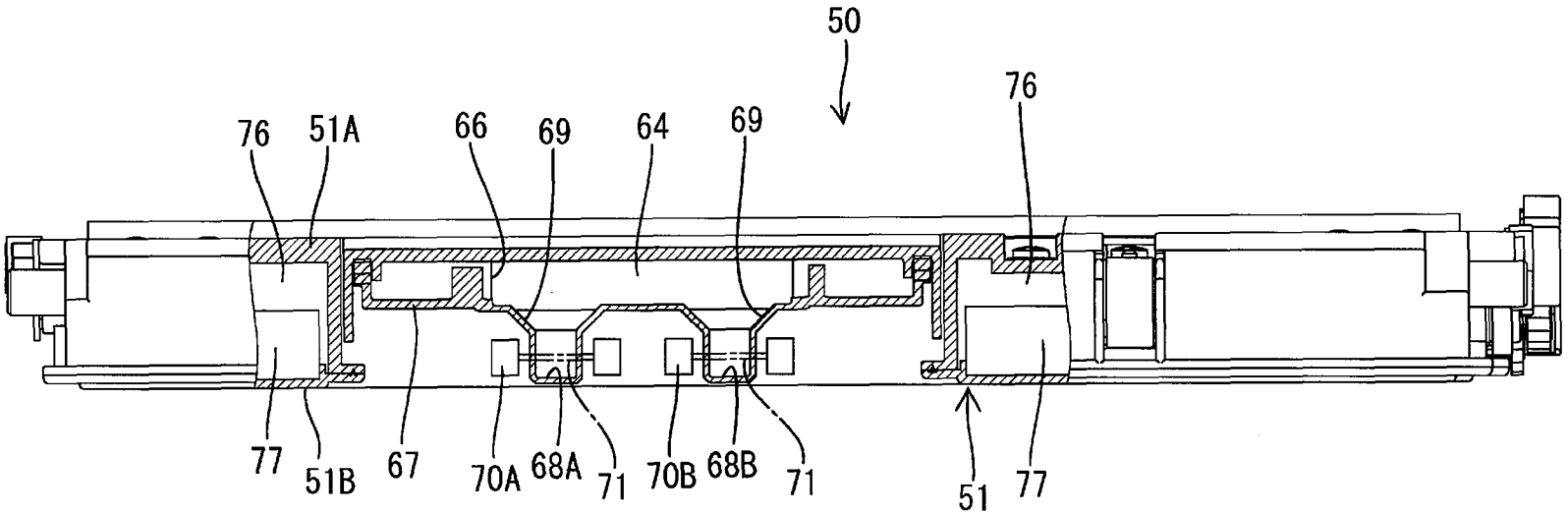
FIG. 3 is a partially cutaway rear view of a cleaning apparatus.
Figure 4:
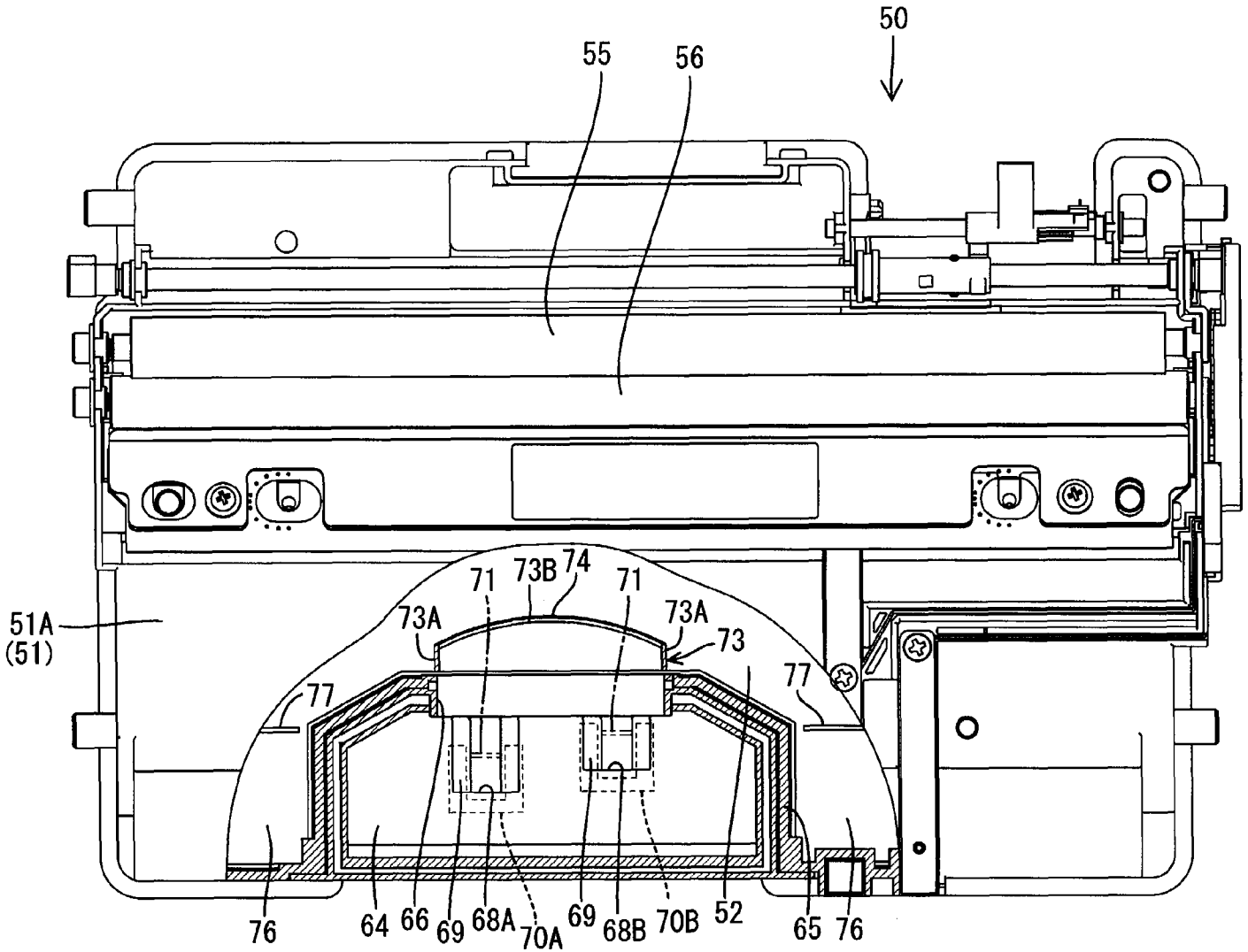
FIG. 4 is a partially cutaway plan view of a cleaning apparatus.
Figure 5:
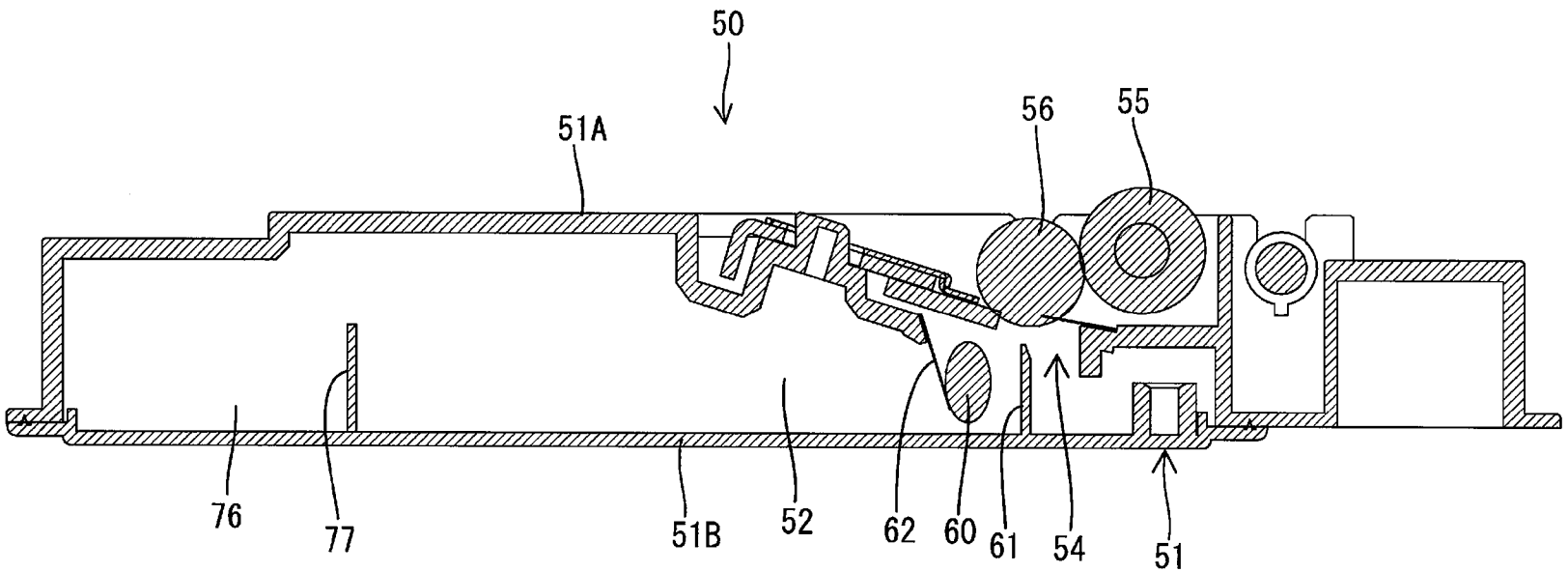
FIG. 5 is a side sectional view of another position of a cleaning apparatus.

FIG. 2 is a side sectional view of a cleaning apparatus 50; FIG. 3 is a partially cutaway rear view of the cleaning apparatus 50; FIG. 4 is a partially cutaway plan view of the cleaning apparatus 50; and FIG. 5 is a side sectional view of another position of the cleaning apparatus 50.

When registration (printing a mark on the surface of the conveying belt 18 for color shift control based on the mark) is performed, toner may be deposited on the surface of the conveying belt 18 or paper powder may be deposited from the recording medium 4. The cleaning apparatus 50 is provided to recover toner and the like remaining on the conveying belt 18.

The cleaning apparatus 50 includes a case 51 (example of accommodating portion). This case 51 may be vertically shallow, horizontally elongated, and formed of a synthetic-resin material. The generally box-like shaped case 51 is detachably inserted into the main body casing 2. A accommodating chamber 52 is formed around a center portion extending to a front portion inside the case 51. The ceiling wall 51A facing the accommodating chamber 52 has the front portion inclined downward, where an opening portion 54 is formed to pass toner through.

Outside the opening portion 54, a cleaning roller 55 and a recovery roller 56 are rotatably arranged in pressure-contact with each other. The cleaning roller 55 can include a silicone foam material wrapped around the periphery of a metal shaft member. Further, the metal shaft member can be arranged to face a metal backup roller 57 with the conveying belt 18 in between. The cleaning roller 55 is driven in the opposite direction to the movement of the conveying belt 18, and a predetermined bias is applied by the cleaning roller 55 and the backup roller 57 onto conveying belt 18. As a result, toner and the like are physically scraped and/or electrically absorbed from the conveying belt 18 to the cleaning roller 55.

When a predetermined bias is applied by the cleaning roller 55 and the recovery roller 56 onto the conveying belt 18, the recovery roller 56, which can be made of metal, absorbs toner and the like deposited on the surface of the cleaning roller 55. In addition, a rubber scraping blade 58 is located under the recovery roller 56, both of which are in elastic pressure contact with each other. The toner and the like remaining on the surface of the recovery roller 56 are scraped away by the scraping blade 58 and then enter the accommodating chamber 52 through the opening portion 54. The cleaning roller 55, the recovery roller 56, the backup roller 57, and the scraping blade 58 described above is one example of a recovery portion according to one aspect of the present invention.

An elliptical rotor 60 having an elliptical cross section is located directly under the opening portion 54 of the accommodating chamber 52. When the elliptical rotor 60 is rotated clockwise as shown, toner deposited on the floor near under the opening portion 54 is pushed backward (rearward) of the accommodating chamber 52. A front restriction wall 61 is installed in front of the elliptical rotor 60 so that when the elliptical rotor 60 is rotated, the front restriction wall 61 prevents toner from being moved forward. A film-like backflow prevention member 62 extending from an opening back end of the opening portion 54 is in elastic contact with a rear surface of the elliptical rotor 60. The backflow prevention member 62 prevents toner from migrating outside the accommodating chamber 52 through the opening portion 54.

A sensing chamber 64 (one example of second chamber)_is located approximately center of the backward portion inside the internal space of the case 51. The sensing chamber 64 is separated from other portions by a sensing chamber wall 65 wrapped around the periphery. An entrance portion 66 is opened at a front center of the sensing chamber wall 65. The sensing chamber 64 and the accommodating chamber 52 are interconnected to each other through this entrance portion 66. The entrance portion 66 is located in an approximately upper half of the accommodating chamber 52.

The bottom wall 67 (bottom face) of the sensing chamber 64 can be formed of a transparent synthetic resin material, and a majority of it located approximately half way between the bottom wall 51B of the case 51 and the ceiling wall 51A of the case 51. A lateral pair of grooves 68A and 68B is recessed on the bottom wall 67, one at right and one at left. Each of the grooves 68A and 68B extends backward from immediately inside the entrance portion 66, and the groove 68A is formed longer than the groove 68B. The bottom faces of the grooves 68A and 68B are approximately as high as the bottom wall 51B of the accommodating chamber 52. An inclined face 69, which is inwardly inclined at both right and left sides, is formed at the opening end of each of the grooves 68A and 68B. Toner is guided inward by this inclined face 69.

The main body casing 2 is provided with a first sensor 70A and a second sensor 70B which can be an example of a sensing portion. Each sensor can be constructed to have a light emitting element and a light receiving element arranged oppositely and adjacent each of the grooves 68A and 68B respectively from both right and left sides. A sensor beam travels from the light emitting element to the light receiving element of each of the sensors 70A and 70B along the light axis 71 which is configured to allow light to pass across each of the grooves 68A and 68B. The first and second sensors 70A and 70B sense a deposition of toner in the grooves 68A and 68B, respectively, based on a signal received from the corresponding light receiving element. As shown in FIG. 4, the light axis 71 of the first sensor 70A is arranged further back (at a longer distance from the entrance portion 66) than the light axis 71 of the second sensor 70B.

A support wall 73 is installed for supporting a partition member 74 in front of the entrance portion 66 (at a side facing the accommodating chamber 52) inside the accommodating chamber 52. The support wall 73 consists of a lateral pair of side walls 73A in a front back direction and a curved wall 73B extending horizontally to connect each front end of the side walls 73A. Each side wall 73A is installed, one at right and one at left of each opening end of the entrance portion 66, and extends from the bottom wall 51B approximately to the ceiling wall 51A. The curved wall 73B is curved with an arched cross section viewed from above. The curved wall 73B has approximately half the height of the side wall 73A, and the upper portion of the curved wall 73B in the support wall 73 is opened.

The partition member 74 consists of a rectangular film-like member, and can be formed of a material with a moderate elasticity. The partition member 74 is supported with the lower half attached to the front face of the curved wall 73B, and with the upper half extending upward of the curved wall 73B so as to almost completely wall up the opening portion of the support wall 73. The partition member 74 is curved along the curved wall 73B viewed from above; in other words, the central portion in the horizontal direction is expanded to form an arched state. When a pressure from toner deposited inside the accommodating chamber 52 exceeds a predetermined value, the partition member 74 falls toward the sensing chamber 64 to an open state. As a result, toner may advance from the accommodating chamber 52 to the sensing chamber 64.

A lateral pair of divided accommodating chambers 76 are formed, one at right and one at left of the sensing chamber 64 in the rear portion (rearward of the accommodating chamber 52) inside the inner space of the case 51. A restriction wall 77, installed on the bottom wall 51B of the case 51, separates the divided accommodating chambers 76 and the accommodating chamber 52, and the divided accommodating chambers 76 is interconnected to the accommodating chamber 52 over the restriction wall 77. The restriction wall 77 is located further back than the entrance portion 66 of the sensing chamber 64, one at the right and one at the left. The restriction wall 77 is as high as or a little higher than the curved wall 73B of the support wall 73. The restriction wall 77 has a function to increase the pressure of toner inside the accommodating chamber 52 as described later.

(Electrical Configuration of Image Forming Apparatus)

Figure 6:
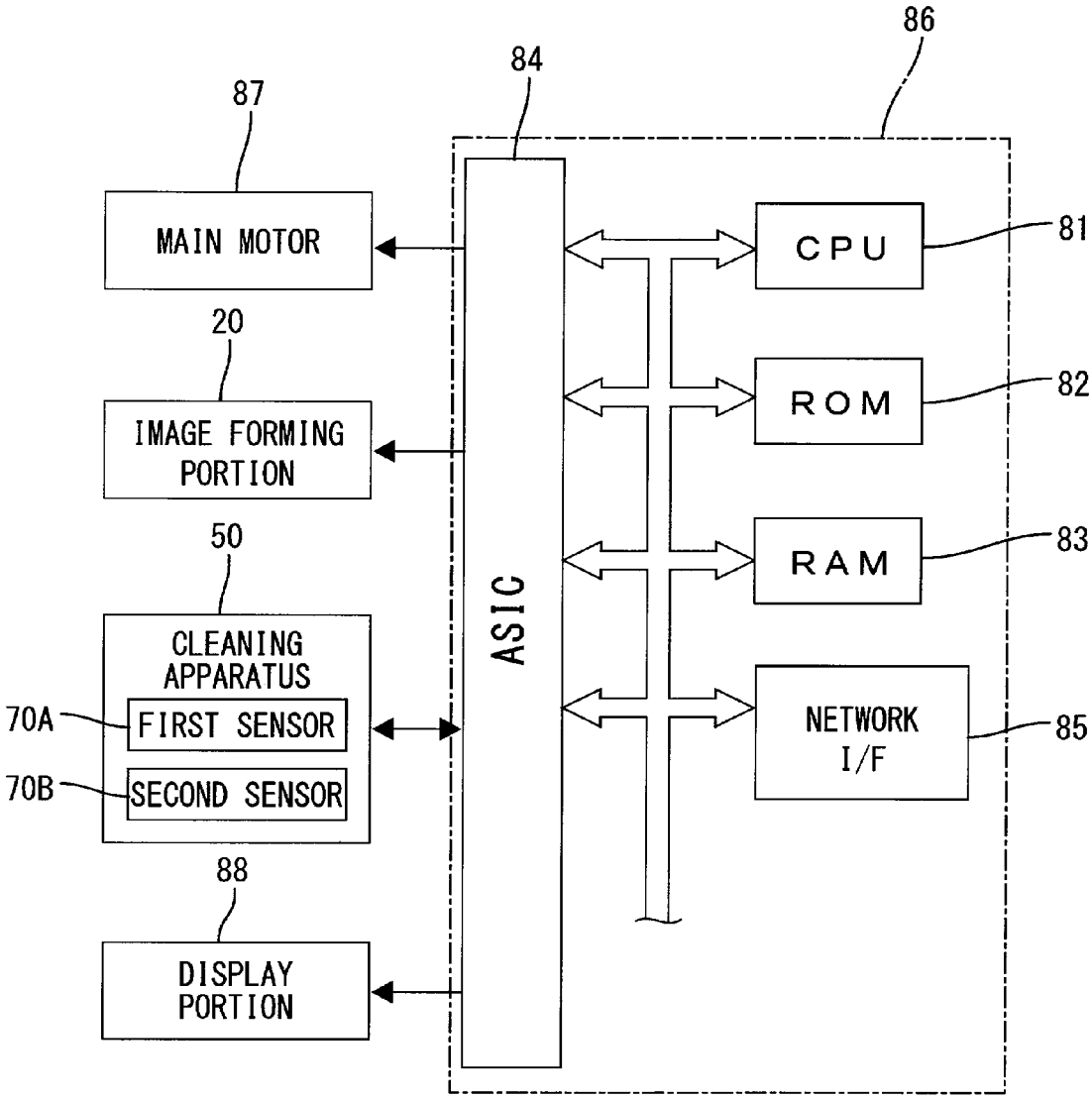
FIG. 6 is a block diagram schematically showing an electrical configuration of a laser printer.

Next, an electrical configuration of a image forming apparatus 1 in accordance with this illustrative aspect will be described. FIG. 6 is a block diagram schematically showing an electrical configuration of the image forming apparatus 1.

The image forming apparatus 1 is provided with a control device 86 can include a CPU 81, a ROM 82, a RAM 83, an ASIC 84, a network interface 85 and the like. The ROM 82 contains various control programs, various settings, default values and the like to control the image forming apparatus 1. The RAM 83 is used as a work area for reading various control programs, or a storage area for temporarily storing image data.

The ASIC 84 (Application Specific Integrated Circuit) is electrically connected to a main motor 87 and aforementioned various components of the image forming apparatus 1 such as an image forming portion 20, a cleaning apparatus 50, and a display portion 88, which is one example of notification portion. The main motor 87 serves as a power source for the photosensitive drum 31, the heat roller 44, the conveying belt 18, as well as the cleaning roller 55, the recovery roller 56, and the elliptical rotor 60 in the cleaning apparatus 50 as described above. The display portion 88 consists of a liquid crystal panel (not shown) located on the upper face of the main body casing 2 to display various pieces of information. The CPU 81 (example of control portion) reads a control program from the ROM 82, stores the processing results in the RAM 83 according to the control program, and controls various components of the image forming apparatus 1 through the ASIC 84.

(Toner Sensing Operation)

Toner guided from the opening portion 54 to the accommodating chamber 52 is pushed backward by the rotation of the elliptical rotor 60, and then deposits inside the accommodating chamber 52. When the pressure of toner applied to the partition member 74 exceeds a predetermined value, the partition member 74 falls backward to allow toner to enter the sensing chamber 64.

Assuming that there is no restriction wall 77 inside the case 51 and the accommodating chamber 52 extends to a position of the divided accommodating chamber 76, toner advances to a position of the divided accommodating chamber 76 without any restriction. As a result, it is difficult to increase the pressure of toner applied to the partition member 74. Accordingly, toner may leak out of the opening portion 54 by an increased pressure of toner in the accommodating chamber 52 before sensing toner that entered the sensing chamber 64 and deposited in the grooves 68A and 68B. In view of such problems, the present illustrative aspect assures that toner enters the sensing chamber 64 since the restriction wall 77 prevents toner from entering the divided accommodating chamber 76 until toner has accumulated to the height exceeding the restriction wall 77. In addition, an increased pressure buildup in the accommodating chamber 52 can be prevented since toner passing over the restriction wall 77 is deposited in the divided accommodating chamber 76.

Toner entering the sensing chamber 64 deposits on the bottom wall 67 of the sensing chamber 64, and at the same time, a part of toner also deposits inside the grooves 68A and 68B. Assuming that the entire sensing chamber is almost as wide as the grooves 68A and 68B, it is difficult for toner to advance smoothly to the sensed position, and thus may be late to sense the toner. However, in this configuration, toner enters the sensing chamber 64 (entrance portion 66), which is wider than the grooves 68A and 68B, and thus the toner can advance smoothly to the sensed position, thereby assuring the sensing accuracy. A sensor beam of each of the sensors 70A and 70B is configured to pass across the grooves 68A and 68B, the distance between the light emitting element and the light receiving element can be shorter than a configuration in which a sensor beam is configured to pass across the entire sensing chamber 64. This allows the sensor light intensity to be lowered, thereby lowering costs.

When either the first sensor 70A or the second sensor 70B senses a deposition of toner, a signal is sent to the CPU 81 which in turn determines a near-full condition and causes the display portion 88 to display a near-full condition indicating that toner in the case 51 has reached a specified amount. This display notifies the user of the near-full condition indicating that toner is nearing a full condition and prompts the user to replace the cleaning apparatus 50. When both the first sensor 70A and the second sensor 70B sense a deposition of toner, the CPU 81 determines a full condition of the case 51, and inhibits printing operation of the image forming portion 20.

According to this illustrative aspect as described above, a full condition and a near-full condition can be detected by sensing toner depositing in the grooves 68A and 68B of the sensing chamber 64 at two sensing positions. The grooves 68A and 68B are placed in the sensing chamber 64 which is separated from the accommodating chamber 52 by way of the partition member 74. Accordingly, the full condition and the near-full condition can be prevented from being sensed before the accommodating chamber 52 is filled with toner, thus increasing the sensing accuracy.

Also assuming that the film-like partition member is arranged straight (linearly), a force (elastic restoring force) that causes toner to resist a pressure may not change greatly between a state (before-open state) of closing the connection between the accommodating chamber and the sensing chamber, and a state (after-open state) of opening the connection between the accommodating chamber and the sensing chamber by a pressure of toner. In this configuration, the smaller the elastic restoring force, the more likely the partition member may be deformed before the accommodating chamber is filled with toner, and the more likely toner may enter the sensing chamber; the greater the elastic restoring force, the more likely the partition member may be opened temporarily, part of developer may enter the sensing chamber, then the partition member may be deformed in a closing direction and push the developer backward, and thus the developer may not smoothly enter the sensing chamber.

In view of this problem, in this configuration, the central portion of the partition member 74 is expanded toward the accommodating chamber 52 to form an arched state. Thus, in a before-open state, a force (rigidity) that resists a pressure of toner in the accommodating chamber 52 is increased enough to prevent toner from entering the sensing chamber 64 before the accommodating chamber 52 is filled with toner. In an after-open state, a comparatively small elastic restoring force is exerted. Thus the partition member 74 may not be deformed by restoration, and toner can smoothly enter the sensing chamber 64, thus increasing the sensing accuracy.

An arched form of the partition member 74 provides a big difference between a force that resists a pressure of toner in a before-open state and a force that resists a pressure of toner in an after-open state, and thus is one aspect of the present invention that provides an advantage over prior configurations.

In addition, the case 51 is detachable. According to this configuration, when the case 51 is removed temporarily for maintenance, the partition member 74 may not be opened by a pressure of toner even if the sensing chamber 64 is tilted downward, since toner falls toward both sides of the partition member 74 in a closed state, in which the central portion of the partition member 74 has its shape expanded toward the accommodating chamber 52. Accordingly, toner can be prevented from entering the sensing chamber 64 before the accommodating chamber 52 is filled with toner.

In addition, the restriction wall 77 prevents toner from entering the divided accommodating chamber 76 until toner reaches a predetermined height, assuring a pressure for opening the partition member 74. At the same time, when toner exceeds the predetermined height, toner enters the divided accommodating chamber 76 over the restriction wall 77, assuring a capacity for storing toner.

In addition, the way toner enters the sensing chamber 64 depends on how toner is accumulated in the accommodating chamber 52. Accordingly, it is difficult to tell which sensor senses toner first in one of the two sensing positions (at the light axis 71 of a light beam) in the sensing chamber 64. More specifically, in this illustrative aspect, the second sensor 70B may generally sense toner first since its sensing position (at the light axis 71 of a sensor beam) is close to the entrance portion 66, but it is also possible that the first sensor 70A may sense toner first. If one of the sensors is specifically configured to sense a near-full condition, and the other sensor is specifically configured to sense a full condition, then if toner reaches a sensing position for sensing a full condition, a near-full condition may not be sensed. In view of this problem, this illustrative aspect assumes that when one of the sensors senses toner, then a near-full condition is determined; when both sensors sense toner, then a full condition is determined. This almost assures that a near-full condition is sensed earlier than a full condition.

Figure 7:
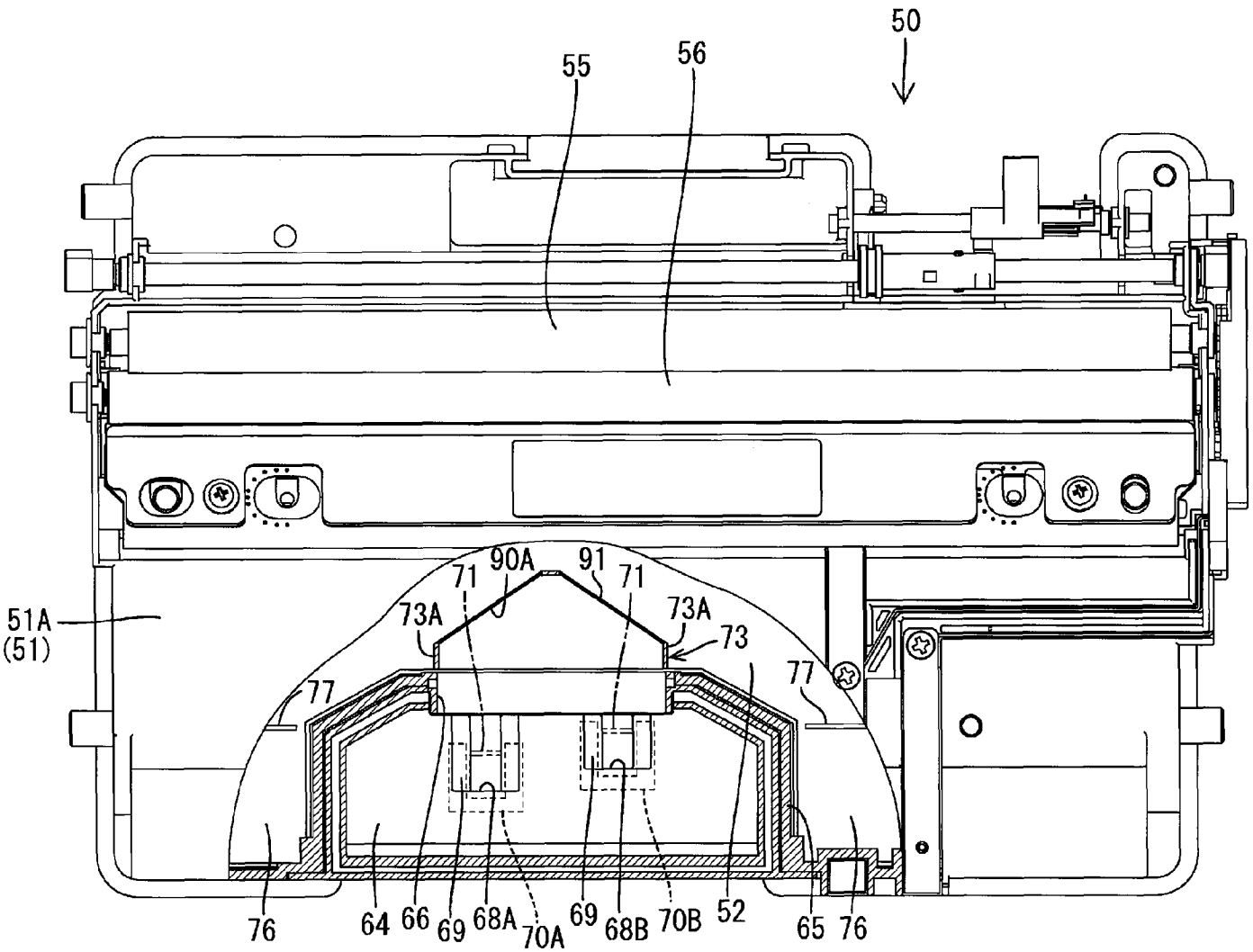
FIG. 7 is a partially cutaway plan view of a cleaning apparatus in accordance with another illustrative aspect.

In the above illustrative aspect, the partition member is assumed to be formed in an arched state, but according to the present invention, the partition member may be formed straight viewed from above, and also may be of other forms. For example, as shown in FIG. 7, a support wall 90 is provided with a tapered wall 90A which replaces the curved wall 73B in accordance with the above illustrative aspect. The tapered wall 90A has the central portion expanding toward the accommodating chamber 52 and the film-like partition member 91 attached on the front face of tapered wall 90A. This form of partition member 91 also increases a force (rigidity) that resists a pressure of toner applied from the accommodating chamber 52, thus increasing the sensing accuracy. In addition, when the case 51 is removed temporarily, and is tilted with the sensing chamber 64 downward, toner falls onto both sides of the partition member 91. Accordingly, the partition member 91 is difficult to be opened by a pressure of toner.

In the above illustrative aspect, pair of grooves is provided with a sensor for each groove, but according to the present invention, only one groove may be provided and a pair of sensors may be provided at the groove. In this case, each sensor may be spaced differently in the front and back direction or in the height direction.

What is claimed is:

1. An image forming apparatus comprising:

an image forming portion configured to form an image using developer;

a recovery portion configured to recover the developer;

an accommodating portion having a first chamber for accommodating developer recovered by the recovery portion;

a second chamber which is connected to the first chamber and has a groove;

a partition member positioned between the first chamber and the second chamber and which is movable by a pressure of the developer deposited in the first chamber; and a sensing portion having two positions for sensing developer deposited in the groove.

2. The image forming apparatus according to claim 1, wherein the partition member is an elastic film, further wherein the partition member has a center portion in the horizontal direction expanded toward the first chamber.

3. The image forming apparatus according to claim 1, wherein the partition member is in the form of an arch.

4. The image forming apparatus according to claim 1, wherein the image forming apparatus comprises a main unit and the accommodating portion is detachably attached to the main unit.

5. The image forming apparatus according to claim 1, wherein the accommodating portion includes a divided first chamber connected to the first chamber, and a restriction wall positioned between the first chamber and the divided first chamber so that developer deposited to a predetermined height in the first chamber passes over the restriction wall.

6. The image forming apparatus according to claim 1, further including a notification portion for issuing a notification indicating that developer in the accommodating portion has reached a predetermined amount.

7. The image forming apparatus according to claim 6, further including a control portion which causes the notification portion to execute a notification when the sensing portion senses developer at any one of the two positions and inhibits the operation of the image forming portion when the sensing portion senses a deposition of developer at both the two positions.

8. An image forming apparatus comprising:

an image forming portion configured to form an image using developer;

a recovery portion configured to recover the developer;

an accommodating portion having a first chamber for accommodating the developer recovered by the recovery portion;

a second chamber which is connected to the first chamber and has a groove;

a partition member positioned between the first chamber and the second chamber and which is movable by a pressure of the developer deposited in the first chamber; and a first and second sensor for sensing developer deposited in the groove.

9. The image forming apparatus according to claim 8, wherein the partition member is elastically deformable, further wherein the partition member has a center portion in the horizontal direction expanded toward the first chamber.

10. The image forming apparatus according to claim 8, wherein the partition member is arch shaped.

11. The image forming apparatus according to claim 8, wherein the image forming apparatus comprises a main unit and the accommodating portion is detachably attached to the main unit.

12. The image forming apparatus according to claim 8, wherein the accommodating portion includes a divided first chamber connected to the first chamber, and a restriction wall positioned between the first chamber and the divided first chamber so that developer deposited to a predetermined height in the first chamber passes over the restriction wall.

13. The image forming apparatus according to claim 8, further including a notification portion for issuing a notification indicating that developer in the accommodating portion has reached a predetermined amount.

14. The image forming apparatus according to claim 13, further including a control portion which causes the notification portion to execute a notification when the sensing portion senses developer at any one of the two positions and inhibits the operation of the image forming portion when the sensing portion senses a deposition of developer at both the two positions.

15. The image forming apparatus according to claim 8, wherein the partition member is tapered.

16. The image forming apparatus according to claim 8, wherein the first and second sensor each include a light emitting portion and a light receiving portion.

17. The image forming apparatus according to claim 8, wherein the first sensor is positioned forward from the second sensor.

18. An image forming apparatus comprising:

an image forming portion configured to form an image using developer;

a recovery portion configured to recover the developer;

an accommodating portion having a first chamber for accommodating the developer recovered by the recovery portion;

a second chamber which is connected to the first chamber and has a groove;

a partition member positioned between the first chamber and the second chamber and which is movable by a pressure of the developer deposited in the first chamber; and a first and second sensor for sensing developer deposited in the groove, wherein when the first and second sensor detect developer, image formation is inhibited.

19. The image forming apparatus according to claim 18, wherein the partition member has a tapered shaped.

20. The image forming apparatus according to claim 18, wherein the first and second sensor each include a light emitting portion and a light receiving portion, further wherein the first sensor is positioned forward from the second sensor.

* * * * *